United States Patent [19]

Mason et al.

[11] 4,271,254

[45] Jun. 2, 1981

[54] PROCESS FOR PRODUCING PHOTOGRAPHIC IMAGES

[75] Inventors: Leslie F. A. Mason, Brentwood; Robert S. Cook; David Kilcast, both of Billericay, all of England; Matthias Schellenberg; Christoph Chylewski, both of Marly, Switzerland

[73] Assignee: Ciba-Geigy AG, Basel, Switzerland

[21] Appl. No.: 108,314

[22] Filed: Dec. 31, 1979

Related U.S. Application Data

[63] Continuation-in-part of Ser. No. 954,251, Oct. 24, 1978, abandoned.

[30] Foreign Application Priority Data

| | | | |
|---|---|---|---|
| Oct. 28, 1977 | [CH] | Switzerland | 13144/77 |
| Oct. 28, 1977 | [GB] | United Kingdom | 44884/77 |
| Nov. 18, 1977 | [GB] | United Kingdom | 40811/77 |

[51] Int. Cl.[3] ..... G03C 7/00; G03C 5/54; G03C 1/40; G03C 1/10

[52] U.S. Cl. ..... 430/239; 430/212; 430/218; 430/222; 430/241; 430/390; 430/392

[58] Field of Search ..... 430/239, 241, 236, 215, 430/218, 222, 262, 390, 392

[56] References Cited

U.S. PATENT DOCUMENTS

| | | | |
|---|---|---|---|
| 2,270,118 | 1/1942 | Gaspar | 430/392 |
| 2,661,293 | 12/1953 | Land | 430/222 |
| 2,971,840 | 2/1961 | Haydu et al. | 430/222 |
| 3,015,561 | 1/1962 | Rogers | 430/222 |
| 3,185,567 | 5/1965 | Rogers | 430/222 |
| 3,394,004 | 7/1968 | Anderau et al. | 430/390 |
| 3,598,589 | 8/1971 | Morgan | 430/392 |
| 3,647,437 | 3/1972 | Land | 430/221 |
| 3,793,022 | 2/1974 | Land et al. | 430/212 |
| 3,816,127 | 6/1974 | Haas | 430/202 |

FOREIGN PATENT DOCUMENTS

| | | | |
|---|---|---|---|
| 1183176 | 4/1970 | United Kingdom | 430/440 |

*Primary Examiner*—Richard L. Schilling

*Attorney, Agent, or Firm*—Sprung, Felfe, Horn, Lynch & Kramer

[57] ABSTRACT

A new method to produce photographic images is provided which comprises (a) imagewise exposing a photographic assembly which contains at least during the silver halide developing step, in order optionally a supercoat layer, at least one silver halide emulsion layer, a layer containing a modifiable image substance and a photobase, there being optionally one or more interlayers between each of said components (b) treating the exposed photographic assembly with an aqueous processing bath so as to provide in the silver halide emulsion layer or layers a solution or dispersion of an image substance modifying/silver halide developing compound (dymodev compound), thereby to develop the latent silver image in the silver halide emulsion(s), and (c) in the non-latent image areas allowing the dymodev compound to diffuse in a counter-imagewise manner from the silver halide emulsion layer(s) to the layer containing the modifiable image substance and there to modify reductively the image substance. Depending on the dymodev compound and modifiable image substance combination closen it is possible to obtain either a negative or a positive image.

42 Claims, 23 Drawing Figures

PROCESS FOR PRODUCING PHOTOGRAPHIC IMAGES

This is a continuation-in-part application of copending patent application Ser. No. 954,251, filed Oct. 24, 1978, now abandoned.

This invention relates to novel methods of processing imagewise exposed silver halide photographic material to produce photographic images and also to novel silver halide photographic material.

Ever since the advent of photography silver halide salts have been used as the photosensitive agent and for the most part developed silver has been used as the image although in colour photography final dye images have replaced the silver image. However in a large number of photographic materials the final image is still a silver image e.g. in X-ray materials, microfilms and in graphic arts films as well as in normal black and white high speed camera films. Recently, however, the price of silver has increased to such an extent that ways have been sought in which silver halide can still be used as the photosensitive agent but in which a final dye image is formed even in the photographic materials listed above. By such means there can be either an almost total recovery of the silver used or at least a great reduction in the amount of silver used.

In one method of colour photography the photosensitive agent is a silver salt and a dye developer is used which develops the silver halide and at the same time releases a dye which diffuses out of the photosensitive layers into a receptor layer which can be peeled apart from the photo-sensitive layer. Thus a final dye image is obtained whilst leaving all the silver in the residual material and thus recoverable. We have discovered a novel photographic diffusion process which does not involve the diffusion of dyes in the photographic material but wherein a final dye image is obtained.

Therefore according to the present invention in a process for the production of photographic images there ar provided the steps of (a) imagewise exposing a photgraphic assembly which comprises at least during the silver halide developing step, in order optionally a supercoat layer, at least one silver halide emulsion layer, a layer containing a modifiable image substance and a support, there being optionally one or more interlayers between each of said components, (b) treating the exposed photographic assembly with an aqueous processing bath so as to provide in the silver halide emulsion layer or layers a solution or dispersion of an image substance modifying/silver halide developing compound, thereby to develop the latent silver image in the silver halide emulsion (s), and (c) in the non-latent image areas allowing the image substance modifying/silver halide developing compound to diffuse in a counter-imagewise manner from the silver halide emulsion layer(s) to the layer containing the modifiable image substance and there to modify reductively the image substance.

By "image substance modifying/silver halide developing compound" (hereinafter referred to as a dymodev compound) is meant a compound which is able to develop a latent silver image and also able to modify an image substance in such a way to obtain image differentiation in the image substance layer which corresponds to the areas of the undeveloped silver and so obtain a photographic image.

The choice of dymodev compound used in the process of the present invention depends on the image substance present in the image substance layer. For example if the image substance is a dye which can be bleached imagewise when present in a layer then the dymodev compound is one which is able to bleach the image dye when the compound diffuses into the image substance layer. Other forms of image substance modification include rendering a dye which is originally layer substantive either solvent soluble or layer non-substantive and able to be washed out of the layer in a further treatment step. Another form of image substance modification is to alter the structure of the image dye so that its spectral absorption is altered. Suitable image dyes of this latter type are often complexes which include a variable valency metal.

These dymodev compounds work in such a way that the image substance remains in the areas of the image layer into which the dymodev compound has not diffused. However in an alternative process, for example, the dymodev compound acts to increase the substantivity of the image substance. Thus in the areas into which the dymodev compound has diffused the image substance is rendered substantive to a particular solvent. Thus on treatment with such a solvent in these areas the image substance remains whilst in the other areas the image substance is removed by the solvent. Thus depending on the dymodev compound and image substance combination chosen it is possible to obtain either a negative or a positive image.

Also it is to be understood that the term "image substance" includes leuco dyes and other initially colourless substances which can be changed into visible images. For example a leuco dye may be present in the image substance layer and a dymodev compound may be used such that when it diffuses into the image substance layer it is able to alter the leuco dye to produce a visible dye therefrom. Another example of an initially colourless substance which can be converted to a coloured substance by the action of a dymodev compound is $MoO_3$. When this substance is acted on by a reduced diazine (which is hereinafter stated can be used as a dymodev compound) the initially colourless $MoO_3$ is converted to a coloured substance. Alternatively the dymodev compound may alter the leuco dye to prevent it from changing into a visible dye. A further treatment step would then be required to change the leuco dye in the areas into which the dymodev compound has not diffused into a visible image dye.

However the preferred image substances of use in the process of the present invention are bleachable dyes and the dymodev compound is a compound which is able to act both as a silver halide developing agent and as an image substance bleaching compound. Such compounds are hereinafter referred to as bleach-developer compounds.

Therefore according to a preferred method of the present invention there are provided processes for the production of a photographic image which comprises the steps of:

(a) imagewise exposing a photographic assembly which comprises at least during a silver halide developing step, in order optionally a supercoat layer, at least one silver halide emulsion layer, a layer containing a substantive bleachable image dye and a support there being optionally one or more interlayers between each of said components.

(b) treating the exposed photographic assembly with an aqueous processing bath so as to provide in the silver halide emulsion layer or layers a solution or dispersion of a bleach developer compound thereby to develop the latent silver image in the silver halide emulsion(s), and (c) in the non-latent image areas allowing the bleach-developer compound to diffuse in a counter-imagewise manner from the silver halide emulsion layer or layers to the layer containing the bleachable image dye and there to bleach the image dye to form a photographic image; or (a) imagewise exposing a photographic assembly which contains at least during the silver halide developing step, in order optionally a supercoat layer, at least one silver halide emulsion layer, a layer containing a preformed substantive bleachable dye or pigment and a support, there being optionally one or more interlayers between each of said components, (b) treating the exposed photographic assembly with an aqueous acid processing bath so as to provide in the silver halide emulsion layer or layers a solution or dispersion of a bleach developer compound which is either a reduced silver dye bleach catalyst which is an azine compound or is a salt of a metallic ion or a complex of a metallic ion with a suitable ligand which is capable of acting as a silver halide developing agent, thereby to develop the latent silver image in the silver halide emulsion(s), and (c) in the non-latent image areas allowing the bleach developer compound to diffuse in a counter-imagewise manner from the silver halide emulsion layer(s) to the layer containing the bleachable dye and there to bleach the bleachable dye or pigment to form a photographic image.

In either the process first set forth or in the preferred process as just set forth the dymodev compound or the bleach-developer compound may be in the form of a preformed solution or dispersion which is applied to the exposed photographic assembly in step (b).

However dymodev compounds and in particular bleach-developer compounds tend to be unstable and thus alternative ways of treating the exposed photographic assembly to ensure that sufficient active dymodev compound enters the silver halide emulsion layer(s) and especially that sufficient dymodev compound diffuses to the image substance layer are preferred.

Thus in one such method the dymodev (or the bleach-developer) compound is an inactive (oxidised) form and a solution or dispersion of this compound is contacted with a substance (reducing agent) which renders the compound active (reduces the compound) just before or whilst the solution or dispersion is applied to the exposed photographic assembly.

In an alternative to this method the photographic assembly comprises either in the supercoat layer or below the supercoat layer but above the bottom-most silver halide layer a compound in layer form which is able to render active a solution or dispersion of an inactive dymodev compound. Thus in this method in step (b) a solution or dispersion of an inactive (oxidised) dymodev compound (or bleach-developer compound) is applied to the exposed photographic assembly and when the inactive compound comes into contact with the activating compound it is rendered active (the oxidised bleach developer is reduced), and thus able to develop the latent silver image.

In a further alternative method the dymodev compound (or bleach-developer compound) is present initially in a layer in the photographic assembly in an inactive oxidised form and in step (b) a solvent for the compound is applied to the exposed photographic assembly and the thus formed solution of the inactive compound is treated in the assembly to convert the compound to the active reduced form. The dymodev compound may be treated in the assembly by providing in the assembly as well a substance in layer form which renders active the inactive dymodev compound. In another method at the same time or just after the solvent is applied in step (b) the photographic assembly is subjected to electrolysis. This converts the dymodev compound (bleach developer) to the active (reduced) form in the assembly.

Similarly electrolysis may be used to convert a solution or dispersion of the inactive dymodev (or bleach-developer) compound to the active form, the electrolysis being applied just before or whilst the solution or dispersion is applied to the photographic assembly.

The term photographic assembly of the type defined as used hereinafter means a photographic assembly as defined in (a) of the two processes hereinbefore set forth, that is to say a photographic assembly which comprises at least during the development of the silver halide emulsion an optional supercoat layer, at least one silver halide emulsion layer, a layer containing a modifiable image substance (bleachable dye or pigment) and a photonase, there being optionally one or more interlayers between each of said components.

According to a modification there is present in this material either in the supercoat layer or in another layer above the layer containing the modifiable image substance (bleachable dye or pigment) (optionally above the silver halide emulsion layer) a layer which is able to activate (reduce) the non-active (oxidised) dymodev compound (bleach developer).

Thus in the process of the present invention when the exposed photographic assembly of the type defined is treated with an aqueous processing bath so as to provide in the silver halide emulsion layer or layers a solution or dispersion of the dymodev compound in the latent image areas of the silver halide emulsion layer(s) the dymodev compound develops the latent silver image and becomes oxidised and thus inactive both as a silver halide developing agent and as a modifying agent for a modifiable image substance. However in the non-latent image areas of the silver halide emulsion layer(s) the dymodev compound in solution or dispersion is able to diffuse through the silver halide emulsion, the compound being unaffected by the non-latent image silver halide. When the dymodev compound reaches the modifiable substance layer it modifies the substance which leads to or forms a photographic image which preferably is of the same type as the silver image formed in the silver halide layer(s). Thus if the image formed in the silver halide emulsion layer(s) is a negative image then a negative dye image is formed in the bleachable dye layer. If the image formed in the silver halide emulsion layer(s) is a direct positive image then the dye image formed in the bleachable dye layer is a direct positive image.

However as hereinbefore stated it is possible by use of suitable dymodev/image substance combinations to produce an image which is the reverse of the developed silver image.

It is to be understood that the image part of the photographic assembly as just defined, that is to say the portion of the assembly which includes both the layer which comprises the modifiable image substance and the support, may be joined initially to the photosensitive portion of the assembly that is to say the portion of the assembly which includes the silver halide emulsion layer(s) or the photosensitive portion of the assembly and the image portion of the assembly may be separate components which are brought together during processing. If the photographic assembly comprises a separate image portion not connected initially to the photosensitive portion after the image has been formed in this portion the two components may be separated. However it is sometimes preferred that after processing the two sheets are retained together.

Preferably when the photographic assembly is in two sections the supercoat layer or some other layer is such as to be able to act as a support for the silver halide emulsion layer(s) and the other layers of this section of the assembly.

It is to be understood that the photographic assembly can and usually does include a number of layers other than the supercoat layer, the silver halide emulsion layer(s), the image substance layer and the optional inter layer or layers between the image dye layer and the support. For example there may be opaque layers, there may be light reflecting layers, there may be timing layers which release alkali or acid or other substances as required and/or there may be mordant layers. The mordant layer(s) may be used for example to mordant released amines when bleachable azo dyes are used as the bleachable image dye. Examples of assemblies of use in the present invention are shown in FIGS. 1 to 23 which follow. However these assemblies are merely representative of the very great number of assemblies which can be used in the process of the present invention.

The term "image substance" includes performed image dyes or the type often used in photographic material such as for example azo dyes, anthraquinone dyes and triphenylmethane dyes. It includes also other coloured compounds such as inorganic dyes, inparticular pigments, which can provide an image and which can be modified. For example it includes metallic oxides such as manganese dioxide and molybdenenum trioxide which can be imagewise modified.

It is to be understood that the term blechable image dye covers a single dye or a mixture of dyes of the same or different colour.

By bleachable image dye is meant a dye which can be used in a silver dye bleach process for example the well-known CIBACHROME (Registered Trade Mark) silver dye bleach process.

By use of the present invention it is possible to form either a negative dye image when using a conventional silver halide emulsion or a direct positive dye image when using a direct positive silver halide emulsion, preferably of the surface fogged type. When using a conventional silver halide emulsion in the process of the present invention after exposure the latent silver images will be in the areas of the silver halide emulsion which have been light exposed. However when using direct positive silver halide material in the process of the present invention the latent silver images will be in the areas of the silver halide emulsion which have not been light-exposed.

In the conventional silver dye bleach process layer-substantive dyes are reductively destroyed in the presence of photographically developed silver. Such dyes are usually azo dyes and their destruction can be represented thus:

$$R{-}N{=}N{-}R^1 + 4H^+ \xrightarrow{Ag} RNH_2 + R^1NH_2$$

The customary known azo dyes, for example those known from British Patent Specifications Nos. 923,265, 999,996, 1,042,300 and 1,077,628 and U.S. Pat. Nos. 3,178,290, 3,178,291, 3,183,225 and 3,211,556, can be used for carrying out the process of the invention.

Suitable bleachable dyes are, moreover, described for example in the Colour Index (third edition), published by the Society of Dyers and Colourists, publishers Lund Humphreys, Bradford and London. In addition to azo dyes it is possible, for example, to use formazan, azoxy, xanthene, azine, triphenylmethane, anthraquinone, nitroso, indigo, nitro-substituted and phthalocyanine dyes, as well as other known dyes, for carrying out the process according to the invention. It is also possible to use precursors of these dyes, for example hydrazo and diazonium compounds, which give azo dyes, and tetrazolium salts which produce formazan dyes. Out of the group of azo dyes which are suitable the ease with which the azo linkages can be broken depends on the nature of the substituents on the nitrogen atoms. The reduction may be a stoichiometric reaction in acid solution with the photographic silver as the reducing agent. Usually there is present a so-called dye bleach catalyst for example certain diazine compounds which form reversible redox systems. These compounds are reduced at the surface of the exposed silver and their reduction products diffuse to the dye and bleach it.

Examples of suitable bleachable image dyes of the azo type are:

Yellow

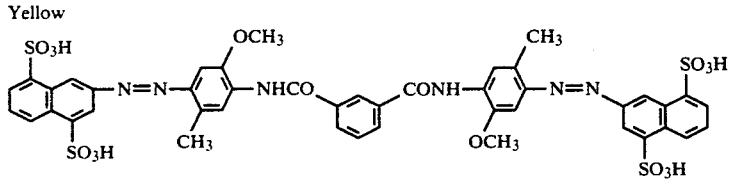

Magenta:

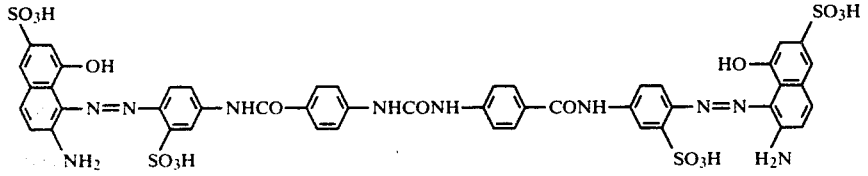

-continued

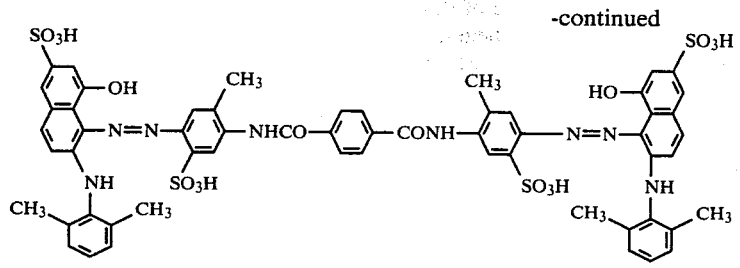

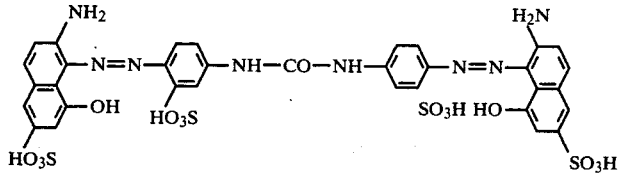

Cyan:

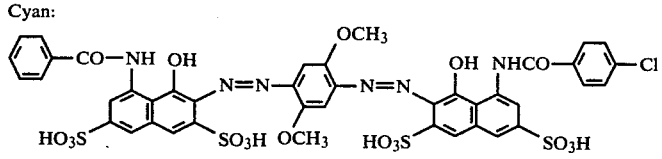

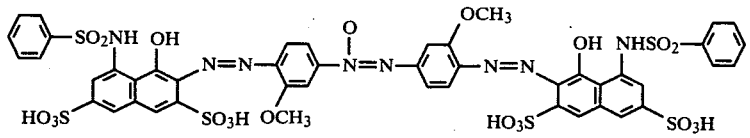

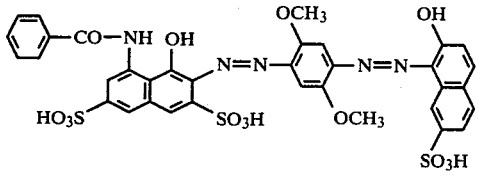

By bleach developer compound is meant a compound which is able both to develop a latent silver halide image and to bleach a bleachable image dye. Various classes of bleach developer compounds are known. Perhaps the best known class is the reduced form of silver dye bleach catalysts. Silver dye bleach catalysts are used in the silver dye bleach process in which they accelerate greatly the silver dye bleach process to bleach the dye in accord with the developed silver areas. Silver dye bleach catalysts work in an acid solution. The most widely used dye bleach catalysts are diazine compounds, especially 1,4 diazines, for example pyrazines, quinoxalines and phenazines in their reduced form.

Examples of suitable diazines are pyrazine and its derivatives and quinoxaline compounds, especially those which are substituted in the 2-, 3-, 5-, 6- and/or 7-position by lower alkyl, hydroxy alkyl or alkoxy ($C_1$–$C_4$), especially methyl, hydroxymethyl or methoxy, further by acylated hydroxymethyl groups (—$CH_2$—$SO_3H$), amino or acylated (acetylated) amino groups, carboxyl, sulfonic acid ($SO_3H$), benzoyl, acetyl, phenyl, benzyl or pyridyl.

The 1,4-diazine compounds are preferably used in the form of aqueous solutions. The solution can also contain a mixture of two or more diazines.

The diazines can be present in the photographic assembly in suspension or as a solution in a high-boiling solvent. Furthermore, the diazines can be incorporated in capsules in the photographic assembly which can be broken by a change in pressure, temperature or pH, in the light-sensitive layer or in an adjacent layer.

Usable dye bleach catalysts are also described in German Auslegeschriften Nos. 2,010,707, 2,144,298 and 2,144,297, in French Patent Specification No. 1,489,460 and in U.S. Pat. No. 2,270,118.

It is known from B.P. No. 1,183,176 that the reduced form of such diazine compounds can act as silver halide developing agents.

Another particularly useful class of bleach-developer compounds are salts of metallic ions and complexes of metallic ions with suitable ligands which are capable of acting as silver halide developing agents.

Metallic ions which are capable of acting as developing agents for latent silver images are well known (see for example Photographic Processing Chemistry by L. F. A. Mason, Focal Press 2nd Edition 1975 pages 177–180). Such metallic ions are the lower valency state ions of variable valency metals. In general they act at low pH's to preserve their active lower valency state.

We have discovered that metallic ions and complexes of metallic ions with suitable ligands which are capable of acting as developing agents for latent silver images in an aqueous acid solution are able also to act in an acid solution as bleaching agents for bleachable dyes. However they are not silver dye bleach catalysts because after bleaching the bleachable dye they become oxidised to their higher valency state but can not be reduced to their lower valency state by metallic silver as are silver dye bleach catalysts.

Preferred metallic ions for use as silver halide developing agents in the process of the present invention are chromous that is to say $Cr^{++}$, vanadous that is to say $V^{++}$ and titanous that is to say $Ti^{+++}$.

There may be present also in the bleach-developer solution which comprises such metal ions a ligand e.g. ethylene diamine tetraacetic acid which beneficially modifies the redox potential of the metal ions.

The preferred bleach-developer compounds of use in the present invention, that is to say the reduced dye bleach catalysts and the lower valency ions of metallic salts or complexes as hereinbefore defined, both act in an aqueous acid solution. However the method of the present invention is not limited to the use of dymodev or even bleach-developer compounds which act only as an aqueous acid solution.

The photographic assembly of the type defined may as previously described consist of two components one the image portion and the other the photosensitive portion. After exposure of the silver halide emulsion layer(s) processing liquid is introduced between them or coated on one of the portions and the two portions are brought together in close contact.

When an assembly of this type is used to perform the invention the processing fluid may contain a pre-formed dymodev compound or an inactive form of the dymodev compound which is not able to act either as silver halide developing agent nor as dye bleaching agent. In the second case when the dymodev compound used is a bleach-developer compound there may be present in the photosensitive portion of the assembly preferably between the supercoat layer and the silver halide emulsion layer(s) a metallic layer as hereinafter described. When the processing fluid is introduced between the image portion and the photosensitive portion the bleach-developer compound diffuses into this metallic layer and there is reduced to its active state. It then diffuses into the silver halide emulsion layer(s) and there the latent image areas of the silver halide are developed by the compound but in the non-latent image areas the compound diffuses into the image portion there bleaching the dye to form a dye image. Thereafter the image portion containing the dye image may be removed from contact with the photosensitive portion of the assembly. If a preformed bleach-developer compound is used in a two-component assembly preferably the supercoat layer comprises one component and the photosensitive portion and image portion are both coated on the photobase and comprise the second component. After exposure of the assembly processing fluid containing the preformed bleach-developer is introduced between the supercoat layer and the emulsion layer. The supercoat layer can be separated from the second component after processing.

However sometimes it is preferable that after processing the two portions of the assembly are not separated but are caused to adhere together. This avoids the production of a disposable photosensitive portion of the assembly.

The formation of the photographic assembly in two halves is of particular use when in-camera processing is to be carried out. In this case in the photographic assembly the photosensitive portion and the image portion may be in contact but not joined. After exposure of the silver halide emulsion layer(s) the processing liquid can be introduced between the two portions, possibly by introducing a pod between the two portions, rupturing the pod and causing the liquid to spread between the two portions which are held in close contact.

However when the photographic assembly is initially in one piece there may be a stripping layer or a stripping position. This layer or position is between the silver halide emulsion layer(s) and the image dye layer. When there is such a stripping layer or stripping position sometimes a final step in the process of the present invention is required to activate the stripping effect and to separate the portion of the photographic assembly which comprises the developed silver image from the portion which contains the final dye image on the photobase.

If there is a stripping layer this may be dissolved in a final wash or solution bath. An example of a suitable stripping layer is a phthalated gelatin layer which is swellable in water. However usually the stripping effect takes place during the processing, because, for example, phthalated gelatin is swellable in an acid processing solution.

Alternatively there may be a stripping position, that is to say the interface between two layers is such that adhesion failure between the two layers can be caused. This adhesion failure may be caused, for example, by change of pH or temperature. The stripping position should be between the silver halide emulsion layer(s) and the image dye layer so that the final step in the process may be to activate the adhesion failure so separating the photosensitive portion from the image portion. However it is usual for adhesion failure to occur towards the end of processing so that often no actual step to activate stripping is required.

When the photographic assembly is initially in two portions or there is either a stripping layer or stripping position in the photographic assembly as hereinbefore defined all the silver used as the photosensitive agent can be recovered as the portion of the material containing the silver may be separated from the final image portion.

However there is considerable saving in silver even when the image portion is not separated from the portion containing the silver. In this case the final viewable image is the dye image which is viewed through the transparent support there being also a silver image in the photographic material which is likely to be separated from the dye image by a white opaque layer. In such material the amount of silver halide present in the silver halide emulsion layer can be less than that which would be required if a viewable image were to be formed in the silver halide emulsion layer(s).

The solution of bleach-developer compound of use in the preferred process of the present invention may be prepared and applied to the photographic assembly in a number of different ways.

For example if the bleach-developer compound used is a reduced diazine compound, this compound may be applied to the photographic assembly as a preformed reduced compound. The methods of forming a reduced derivative of 1,4-diazine compound are described in British Patent Specification No. 1183176.

Alternatively, and this is preferred, the reduced diazine compound is produced during the processing step from a diazine compound or from a N-oxide derived therefrom by use of a reducing agent in layer form in an acid medium, the said reducing agent being a metal which in the electrochemical series of the elements is above silver and up to and including aluminium. This method of processing is described in B.P. Specification No. 1330755. For the present invention the reducing agents can be metals, which are in the electrochemical series above silver and up to and including lanthanum, preferably up to and including aluminium, such metals are e.g.; copper iron, lead, tin, nickel, cobalt, indium gallium, cadmium, manganese, aluminium, lanthanum and the lanthanides. Further alloys containing these metals or said metals in amalgamated form can be used.

For example there may be used a vacuum deposited coated metal strip for example a tin or copper film base strip and there is coated on to this coated strip or on the exposed photographic material a solution or paste which comprises a 1,4-diazine compound in an acid solution. The diazine compound is reduced by the metal and diffuses into the photographic material where the reduced diazine compound in the presence of the acid solution acts as a developing agent for the exposed silver halide.

Alternatively there may be present in the photographic material a layer which contains a fine or colloidal dispersion of a metal which in the electrochemical series is above silver and up to and including aluminium. In fact a colloidal dispersion of aluminium is particularly useful.

In a further alternative method the reduced diazine compounds may be formed in the assembly during the development step by electrolysis.

Similarly if the bleach-developer compound comprises simple or complexed metallic ions in a reduced state these ions may be prepared and applied to the photographic assembly in a number of different ways.

For example ($a_1$) a preformed acid solution of the metallic ions may be used, ($b_1$) the acid solution of the metallic ions may be formed externally to the photographic assembly but as a step in the processing sequence, ($c_1$) the acid solution of the simple or complexed reduced metallic ions may be formed in situ in the photographic assembly during the processing sequence.

Thus in the method ($a_1$) above the reduced metal ion may be preformed by known methods, such as electrolytic reduction of a suitable oxidised form or formation of the required metal ion complex by admixture of suitable starting materials in the required oxidation state.

When method ($b_1$) is used a strip (foil) of a second metal or a strip having a fine colloid dispersion of a second metal coated thereon is used: the second metal having a reduction potential sufficiently negative to achieve reduction of the oxidised form of the metallic ion to the reduced form of the metallic ion. The metal strips are e.g. composed of aluminium, iron, zinc or tin; further of indium or alloys which include such metals. When employed in a fine colloid dispersion the metals are for example zinc, tin, iron, nickel, aluminium or indium may be used, further gallium lanthanum, or alloys containing these metals.

There is coated on to this coated strip which is then applied to the exposed photographic assembly a solution or paste which comprises an oxidised form of the metallic ion in acid solution. The oxidised form of the metallic ion is reduced by the second metal and diffuses into the photographic assembly where the reduced form of the metallic ion in the presence of the acid solution acts as a developing agent for the latent silver halide. In case ($c_1$) there may be present in the photographic assembly a layer which contains a fine or colloid dispersion of a second metal which can reduce oxidised forms of the metallic ions to produce the active form of the ions. Such metals are aluminium, copper, zinc, tin, iron, nickel, gallium or indium, further lanthanum or alloys which include such metals. Also in method ($c_1$) the reduced metallic ions may be formed electrolytically in the assembly during the silver halide developing step.

Preferred metals amongst these are those which do not react rapidly with atmospheric oxygen and water at room temperature.

If desired, complex-forming agents for the metals can also be employed during processing.

For example, the fluoride ion forms complexes with aluminium-III ions and the copper-I ion is bonded as a complex by, for example, nitriles, olefines, chloride ions, bromide ions and thioethers. A large number of ligands and also the stability constants of the complexes formed therefrom with various metal ions are listed in the book "Stability Constants of Metal-Ion Complexes, Special Publication No. 17, London: The Chemical Society, Burlington House, W.1, 1964".During processing, a complex-bonded metal ion forms from the complex-forming agent (for example fluoride ions from $NH_4F$ or $CaF_2$ for Al), incorporated in the processing solution or in the material, and the metal, which is present in the form of a layer in the photographic material or is brought into contact with the photographic material during processing, with interposition of the processing bath, and by this means an increase in the reactivity of the metal is achieved.

The use of sparingly soluble compounds as donors of complex-forming agents, for example $CaF_2$ as a fluoride ion donor, has the advantage that an adequate amount of ligand for forming the complex is available without, at the same time, a momentarily undesirable high excess of ligand being present in the solution.

The metals can be distributed in the form of small particles in a layer containing a silver salt or in an adjacent auxiliary layer which may be present. Auxiliary layers can be bonded to the silver salt emulsion layer in an inseparable or readily separable manner. The particles can be dispersed direct in a layer colloid or can additionally be surrounded by a coating of a polymeric substance. Furthermore, the metal particles can be contained in capsules which can be broken open by a change in pressure, temperature or pH. In addition the metals can be supplied for use from small particles of a polymeric substance provided with a metallic coating.

Various embodiments of photographic assemblies of use in the present invention will now be described with references to the accompanying FIGS. 1 to 23.

In FIGS. 1 to 13 the term stripping position has been used, however this may be either an interface between layers at which adhesion failure may occur or it may indicate an actual stripping layer.

Figure 1:
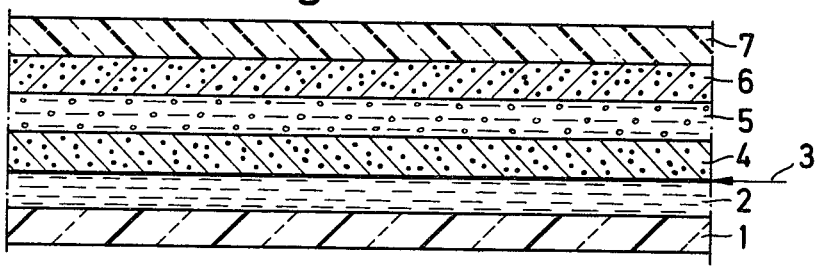
FIGS. 1 to 13 show assemblies which comprise either a stripping position or stripping layer.

In FIG. 1 there is shown a photographic material according to the present invention which can be used for X-ray film material.

As shown in FIG. 1 the material comprises a transparent support 1 having coated thereon a bleachable dye-in-gelatin layer 2. Above this is the stripping position 3. Above the stripping position 3 is a carbon black layer 4 and above this a conventional silver halide emulsion layer 5, then a carbon black layer 6 and above is a supercoat layer 7. Thus the silver halide emulsion layer 5 is sandwiched between two carbon black layers 4 and 6 and therefore the photographic material can be handled in daylight. The material may be exposed to X-rays and after exposure it can be processed using an aqueous acid solution of the bleach-developer compound as just described to yield a negative silver image. The silver halide layer and the two carbon black layers and the supercoat layer are then stripped off the dye layer for recovery of the silver. The negative dye image on the support can then be viewed by transmission.

For convenience the expression "X-ray" as used in the specification is intended to cover all very short wave photographically useful radioactive rays such as those emanating from an X-ray tube, radium or radioactive isotopes.

Figure 2:
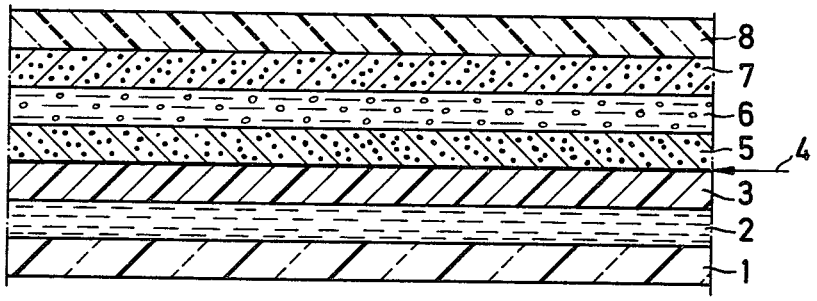

In FIG. 2 there is shown photographic material according to the present invention which can be used as X-ray material for reflection viewing. In this embodiment there is coated on a transparent film support 1 in order a bleachable dye-in-gelatin layer 2, a white opaque layer 3, stripping position 4, a carbon black layer 5, a conventional silver halide emulsion layer 6, a carbon black layer 7 and a supercoat layer 8.

In this case as in the case of the material of FIG. 1 the photographic material is processed to yield a negative image. But in this material an extra white opaque layer is present. This may consist for example of baryta or titanium oxide dispersed in gelatin. In this material the white opaque layer acts as a reflective base for the negative dye image which is viewed by reflection through the film support.

Figure 3:
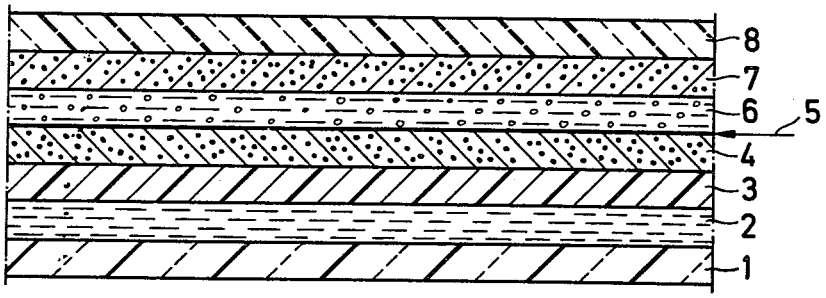

FIG. 3 shows an alternative embodiment of the material of FIG. 2. In this figure the layers have the same numbers as in FIG. 2 but the stripping position has now been altered and is between the lower carbon black layer 5 and the silver halide emulsion layer 6. When the silver halide emulsion layer is stripped off after processing the carbon black layer is then attached to the white opaque layer.

The main advantages of the photographic material as described with references to FIGS. 1 to 3 is that all silver in the silver halide emulsion layer may be recovered and the film material is insensitive to daylight and thus may be handled in the unexposed state in normal daylight conditions. However the photographic material of the present invention can also be used in a normal camera or process camera if the top carbon black layer is omitted. Such material in which there is no carbon black layer at all is shown in the accompanying FIG. 4 in which there is coated on an opaque support 1 in order a bleachable dye-in-gelatin layer 2, stripping position 3, a silver halide emulsion layer 4 and a supercoat layer 5. Preferably this material comprises in layer 4 a direct positive emulsion and thus when processed yields a direct positive dye image which is viewed by reflection. In this case the material cannot be handled at any stage in daylight conditions before the silver halide layer has been stripped off.

Figure 5:
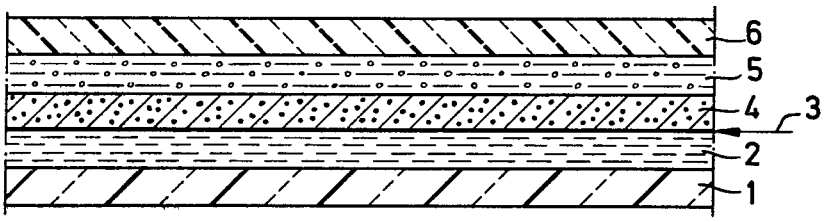

Yet another embodiment of the material of the present invention is shown in the accompanying FIG. 5. In this material there is coated on a transparent support 1 in order a bleachable dye-in-gelatin layer 2, stripping position 3, carbon black layer 4, silver halide emulsion layer 5 and supercoat layer 6. In this case the material produces a final dye image which may be viewed by transmission. In the case of this material exposure must be in a camera or other light-tight exposure chamber. However if the material is processed by a method wherein an activator metal foil which is light opaque is placed in contact with the photographic material on the supercoat side then the processing may be carried out under daylight conditions.

Figure 6:
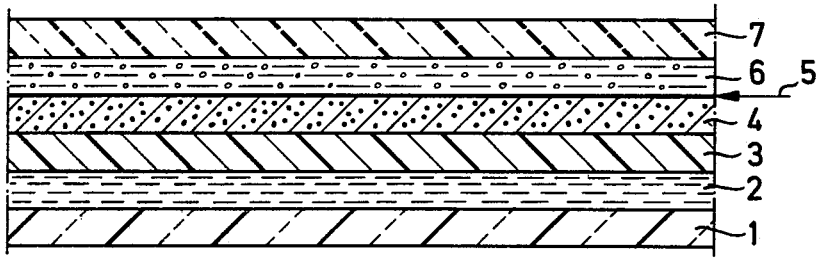

Another embodiment of the invention is shown in FIG. 6 in which there is coated on a transparent support 1 in order a bleachable dye-in-gelatin layer 2, white opaque layer 3, carbon black layer 4, stripping position 5, silver halide layer 6 and supercoat layer 7. In this case also, exposure must be in a camera or light-tight exposure chamber. The silver halide emulsion layer 6 may be a direct positive emulsion and in which case after processing there is produced a direct positive image which is viewed by reflection. Alternatively if a conventional silver halide emulsion is used there is produced a negative image which is viewed by reflection, although of course it would be more usual in this case to employ material which would produce a direct positive image as the image is viewed by reflection unless exposure were to X-rays when it is usual to view negative images.

The assemblies shown in FIGS. 1 to 6 may be processed by the application of an acid solution which comprises a bleach-developer compound. This bleach-developer compound may be a preformed reduced azine for example the dihydro derivative of methyl acetyl quinoxaline which remains as the active compound for some time especially if kept under a nitrogen atmosphere. However bleach-developer compounds which comprise an aqueous acid solution of metallic ions in their lower valency state are especially suitable, e.g. titanous ions stabilised with ethylene diamine tetraacetic acid. Such solutions remain active for some time. Alternatively as mentioned with reference to FIG. 5 the inactive bleach-developer solution can be used together with an activator metal foil e.g. aluminium or zinc foil, the metal reducing the inactive bleach-developer to the active form as it contacts the photographic assembly.

Figure 7:
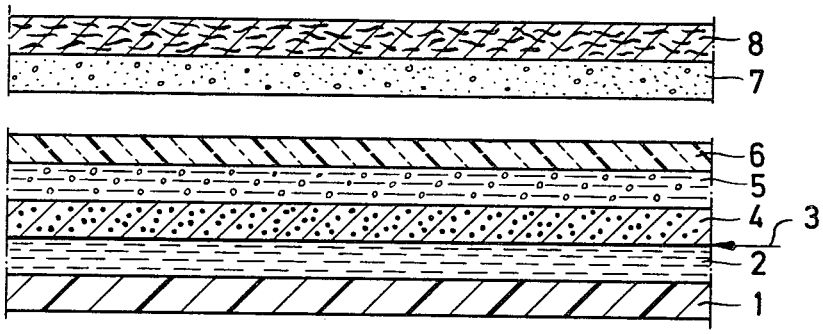
Figure 8:
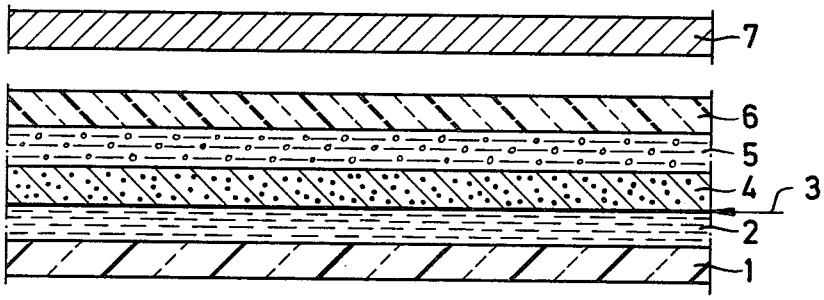

Such methods of processing are shown in FIGS. 7 and 8. In FIG. 7 the photographic assembly comprises a white reflecting support 1 on which is coated a bleachable dye-in-gelatin layer 2. A stripping position 3 is present between layer 2 and layer 4 which is a black opaque layer and coated on layer 4 is a silver halide emulsion layer 5 on which is coated a thin supercoat layer 6.

The inactive bleach-developer solution is applied to the supercoat layer 6 and the assembly is then contacted with a zinc paste layer 7 which is coated on to a black opaque paper support 8.

The material of FIG. 7 can be processed in the light after the black paper has been brought into contact therewith.

A dye image is obtained in the image layer 2 and layers 4–8 are stripped off.

In FIG. 8 the material of FIG. 5 is shown with an aluminium foil 7 above it. After exposure the inactive bleach-developer acid solution is placed on the supercoat layer 6 and the metal foil pressed in contact therewith.

FIGS. 9–13 show similar assemblies to those of FIGS. 1–6 in that each comprises a stripping layer but in the case of the assemblies 9–13 each also comprises a metal activating layer.

Figure 4:
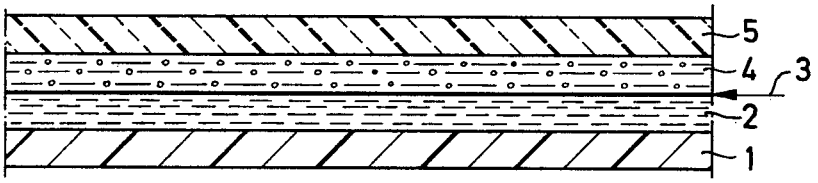
Figure 9:
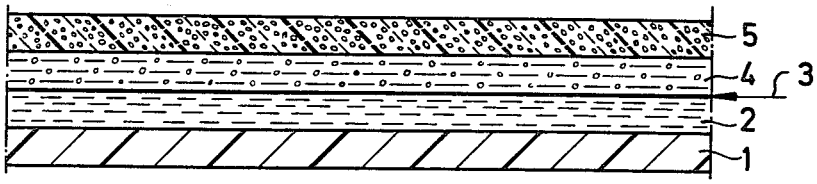

The assembly of FIG. 9 is similar to the assembly of FIG. 4 but there is present in the supercoat layer 5 a dispersion of zinc powder.

Figure 10:
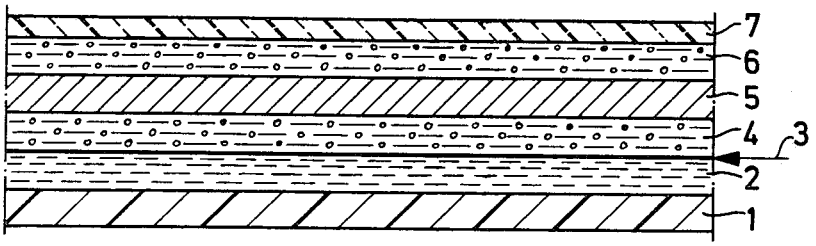

The assembly of FIG. 10 is somewhat similar to that of FIG. 4 except that coated on the metal layer 5 is another silver halide emulsion layer 6 and coated on that a thin supercoat layer 7. The presence of the second silver halide emulsion layer is to enhance the dye image formed in layer 2.

Figure 11:
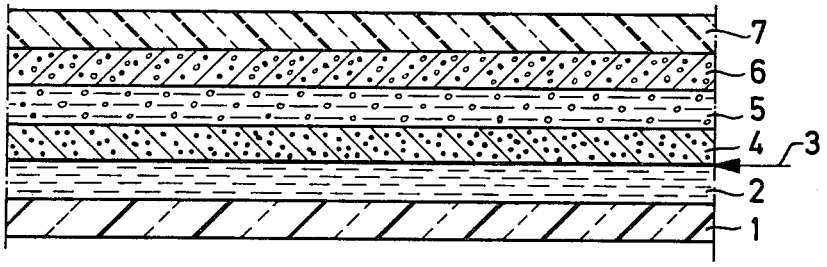

The assembly of FIG. 11 is similar to the assembly shown in FIG. 1 except that in the carbon black layer 6 of FIG. 1 there is present a fine dispersion of aluminium metal particles.

Figure 12:
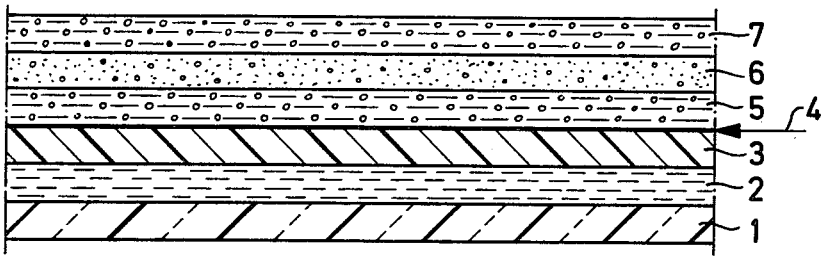

In the assembly shown in FIG. 12 there is a transparent support 1 on which is coated a bleachable dye-in-gelatin layer 2, a white reflecting layer 3, a silver halide emulsion layer 5, a copper particle layer 6 and a silver halide emulsion layer 7. After exposure an inactive bleach-developer solution is applied to the emulsion layer 7 and this diffuses down to the metal layer 6 where it becomes activated. The active bleach-developer compound develops the latent image in both of the silver halide emulsion layers and in the non-latent image areas diffuses to the bleachable dye layer 2 where it bleaches the dye to form a dye image. The stripping layer 4 is then activated and the dye image can be viewed through the base against the white reflecting layer 3. The effect of the two silver halide emulsion layers is to strengthen the dye image formed in layer 2.

Figure 13:
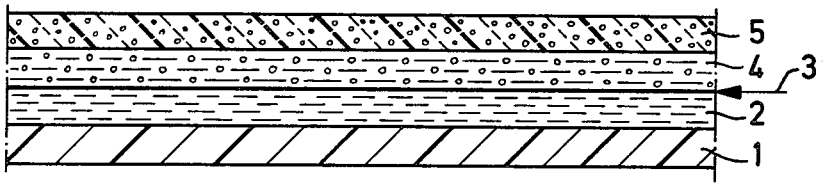

The assembly shown in FIG. 13 is similar to the assembly shown in FIG. 4 except that the supercoat layer 5 of FIG. 4 comprises a fine dispersion of zinc metal flakes.

Processing of the assemblies shown in FIGS. 9–13 is carried out by applying to the topmost layer an acid solution of an inactive bleach-developer compound. When the inactive bleach-developer compound reaches the metal layer it becomes active and is able to develop the latent silver image in the silver halide emulsion layer or layers and after diffusion into the bleachable dye layer there to bleach the dye to form an image.

Photographic assemblies for use in the present invention which are integral, i.e. which remain in one piece after processing are shown in FIGS. 14–19.

Figure 14:
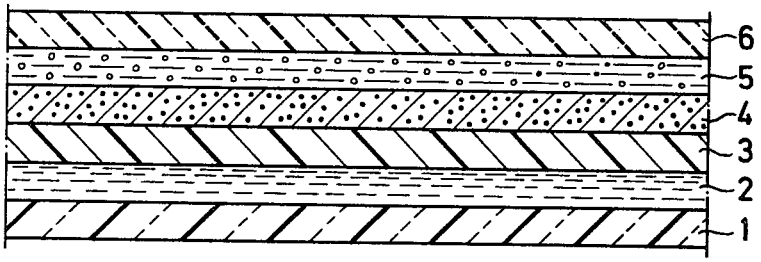
FIGS. 14 to 19 show integral assemblies.

In FIG. 14 there is coated on a support 1 in order a bleachable dye-in-gelatin layer 2, a white reflecting layer 3, a carbon black opacifying layer 4, a silver halide emulsion layer 5 and a supercoat layer 6. Exposure must be in a camera or light-tight exposure chamber. The emulsion layer 5 may be chosen to produce a direct positive image or a negative image.

Figure 15:
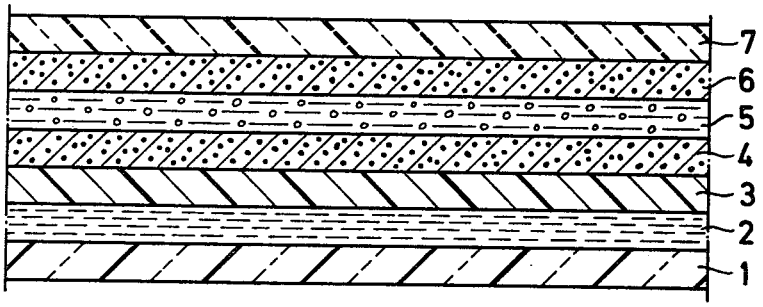

In FIG. 15 there is coated on a support 1 in order a bleachable dye-in-gelatin layer 2, a white reflecting layer 3, a carbon black opacifying layer 4, a silver halide emulsion layer 5, a carbon black opacifying layer 6 and a supercoat layer 7. Exposure of this material must be to X-rays. The silver halide emulsion of this layer would normally be a conventional emulsion so yielding a negative image to be viewed by reflection as X-ray films are by custom processed to yield negative images.

Figure 16:
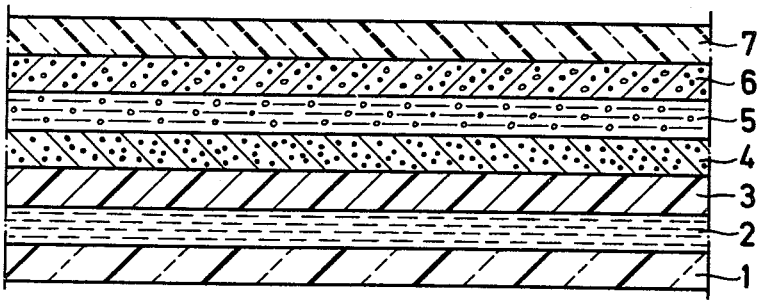

In an alternative embodiment shown in FIG. 16 layer 6 instead of being a carbon black opacifying layer is a zinc powder+carbon black opacifying layer. Such material can be processed after exposure to yield a dye image therein by application of an acid solution of an unreduced bleach-development compound of the type wherein the reduced form acts as a silver halide developing agent.

Figure 17:
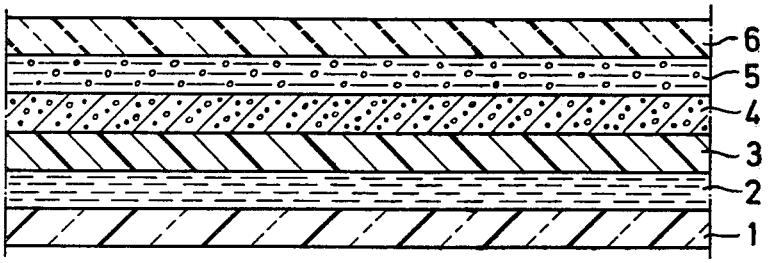

The assembly of FIG. 17 is similar to that of FIG. 16 except that the carbon black+zinc layer is located between the silver halide emulsion layer and the white reflecting layer and there is no top carbon black layer.

The assemblies of FIGS. 15 and 16 can be exposed only to X-rays but can be daylight processed whilst the assembly of FIG. 17 is light-sensitive and the usual precautions must be taken during exposure and also during processing unless a light-opaque mask is placed over the assembly during processing.

Figure 18:
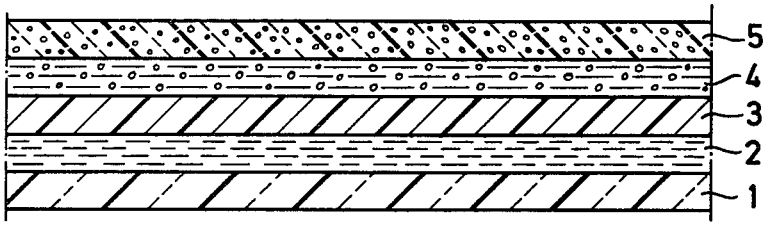

In the assembly shown in FIG. 18 a transparent support 1 has coated thereon a bleachable dye layer 2, a white reflecting layer 3, a silver halide emulsion layer 4 and a supercoat layer 5 which comprises fine zinc metal plates.

Application of an acid solution of an inactive bleach-developer causes the bleach-developer to diffuse into the metal layer where it becomes activated and then to the silver halide emulsion layer where the bleach-developer compound develops the latent silver image. In the non-latent images areas it diffuses to the bleachable dye layer where it contra-silver-imagewise bleaches the dye to form a dye image.

Figure 19:
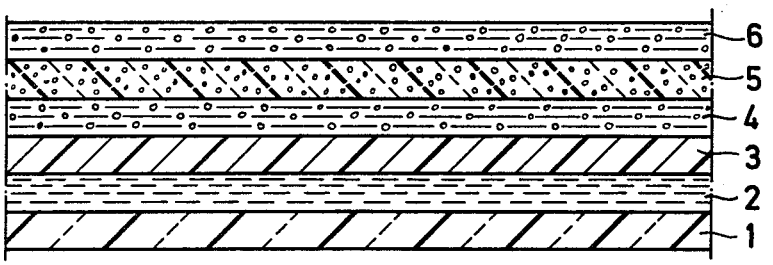

The assembly of FIG. 19 is similar to that of FIG. 18 except that coated on layer 5 is another silver halide emulsion layer 6. The effect of the second silver halide emulsion layer is to reinforce the final dye image in layer 2.

In none of the assemblies shown in FIGS. 14–19 is there a stripping position or layer. This means that all the silver present initially is still present in the final image material. However it is possible to make use of a very low coating weight of silver which when the material is exposed and processed yields a very low density image, too low in fact to be of use as a final image. However the final image in the assemblies of FIGS. 14–19 is a dye image of very acceptable density as a final image. Thus the amount of silver used can be small as the silver is used merely as the radiation sensitive agent and not as the image-producing substance as well although it is still present in the assembly but is invisible as it is on the other side of the white reflecting layer to the dye image.

Figure 20:
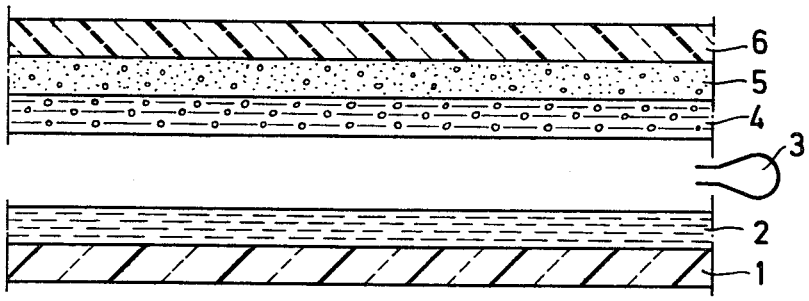
FIGS. 20 to 22 show assemblies which comprise a photosensitive portion and an image portion which are only brought together during processing.

In FIG. 20 there is shown a photographic assembly of use in the present invention which comprises two separate components. The image component consists of a transparent support 1 on which is coated a bleachable dye-in-gelatin layer 2. The photosensitive component comprises a supercoat layer 6 which is transparent but which is sufficiently thick and rigid to act as a photobase. On layer 6 is coated a metal powder (e.g. aluminium, zinc or copper) and gelatin binder layer 5. On layer 5 is coated a camera speed silver halide emulsion layer 4.

Between layer 4 and layer 2 there is shown a pod 3 which contains an acid solution of a bleach-developer compound in its higher valency state but which in its lower valency state is able to act both as a silver halide developing agent and as a dye bleaching agent.

The assembly of FIG. 20 is of use in a self-processing camera of the type known per se. In operation the assembly preferably with the pod 3 already in position between the two components of the assembly is imagewise exposed through the supercoat layer 6. After exposure the assembly is led through a pair of driven rollers which rupture the pod 3 and cause the processing fluid contained therein to spread evenly between the two components and it also brings the two components into very close contact. The unreduced bleach-development compound in the acid solution then diffuses into both components but is not able to either develop the latent image in the silver halide nor bleach the dye until some of the compound has reached layer 5. There it is reduced to the active form. The reduced compound then diffuses through the assembly.

In layer 4 it develops the latent image areas and is de-activated. In the non-latent image areas it continues to diffuse down through the thin layer of solution between layers 4 and 2 and into layer 2 where it acts to bleach the imagewise bleachable dye to form a dye image.

In this case as a camera speed emulsion is used the emulsion is preferably a negative emulsion. Thus a negative dye image will be formed.

Figure 21:
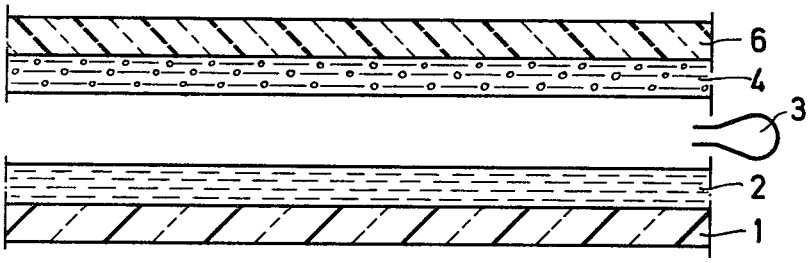

The assembly of FIG. 21 is similar to that of FIG. 20 except that in the silver halide emulsion layer 4 there is also present fine particles of zinc dust and no metal layer 5.

Figure 22:
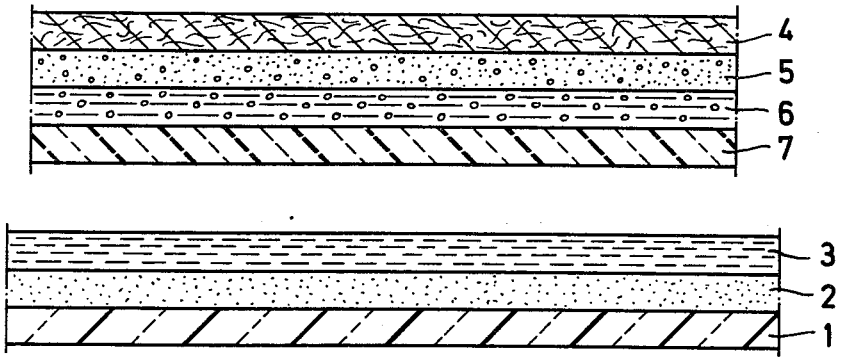

In FIG. 22 there is shown another photographic assembly of use in the present invention which comprises two separate components. The lower component comprises a transparent support, a neutralising layer 2, a bleachable dye(s)+gelatin layer 3. The upper component comprises coated on a paper base 4 a zinc powder+binder layer 5, a silver halide emulsion layer 6 and a supercoat layer 7. The lower component may be part of a long web of material.

In operation after the upper component has been imagewise exposed in a camera through the supercoat layer 7 the upper component is placed juxtaposed the lower component, layer 7 facing layer 3. Then an inactive form of bleach-developer compound is spread either as a dispersion or as a solution on either layer 7 or layer 3 and the two components are held together in close contact.

The inactive bleach-developer compound then diffuses into layer 5 where it is converted to the active form. It then diffuses into layer 6 where in the latent image areas it develops the latent silver image whilst in the non-latent image areas it diffuses in counter-imagewise fashion through the protective layer 7 to the dye layer 3 where it bleaches the dye thus yielding a dye image. The upper component can then be removed and the silver recovered therefrom. The image can be viewed through the transparent base. In practice if the lower component is part of a web a series of dye images will be present along the length of the web if the process has been repeated using a series of exposed upper components.

Figure 23:
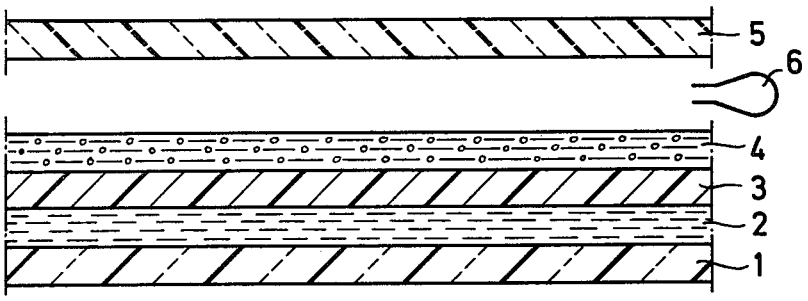
FIG. 23 shows an assembly in two sections suitable for in-camera processing.

In FIG. 23 there is shown a photographic assembly of use in the present invention which comprises two separate components. The first component consists only of a separate supercoat 5. The other component comprises a transparent support 1 having coated thereon in order a bleachable image dye layer 2, a white reflecting layer 3, and a silver halide layer 4. Between the supercoat layer 5 and the silver halide layer 4 is shown a pod 6 which contains a preformed bleach-developer compound.

The assembly of FIG. 23 is of use in a self-processing camera of the type known per se. In operation the assembly with the supercoat layer 5 in close contact with the silver halide emulsion layer 4 is imagewise exposed in a camera. Preferably the pod 6 is present in the assembly with its outlet between two edges of the supercoat and silver halide layers but is so positioned that close optical contact between these two layers is not impaired.

After exposure the assembly is led through a pair of driven rollers which rupture the pod 6 and cause the processing fluid contained therein to spread evenly between the supercoat layer 5 and the silver halide layer 4. The preformed bleach-developer compound then diffuses into the silver halide layer and develops the latent image therein in the latent image areas. In the non-latent image areas it diffuses in a counter-imagewise manner through the white reflecting layer 3 and into the dye(s)+gelatin layer 2 where it bleaches the bleachable layer to form a dye image. The image can then be viewed by reflection through the support 1.

An example of a suitable white reflecting layer for use in the material of FIGS. 2, 3, 6, 8, 12, 14–19 and 23 is as follows:

| | |
|---|---|
| Titanium dioxide (mean particle size 1.5μ) | 15 g |
| Gelatin (4% aqueous solution) | 50 ml |
| Sodium dodecyl sulphate (28% aqueous solution) | 0.3 ml |
| Aryl alkyl polyethylene oxide condensate (6% solution in 50/50 ethanol/water | 3.0 ml |

dispersed using a homogeniser or ultrasonic mixer coated to give a layer containing 27 g.m.$^{-2}$ $TiO_2$.

An example of a suitable carbon black layer for use in the material of FIGS. 1–3, 5–8, 11 and 14–17 is as follows:

| | |
|---|---|
| Gelatin | 3 g |
| Water | 40 ml |
| Carbon black dispersion | 5 ml |
| Wetting agent (5% aqueous solution) | 2.5 ml |

mixed gently for two minutes
coated to give a layer containing 2.7 g.m.$^{-2}$ C.

There may be present in the photographic material of the present invention yet other layers for example a neutralising layer, a timing layer, a mordant layer which may be used to trap amines released during the bleaching of azo dyes when such dyes are used as the image dye, or a layer to control the swelling of the gelatin layers. Preferably any of the above layers, if present, are located between the supercoat layer and the silver halide emulsion layer or between the dye layer and the support so as not to prolong nor interfere with the diffusion path of the bleach development compound to the bleachable dye layer.

The preferred binder for all layers is gelatin. However so-called gelatin extenders may be present for example those derived from synthetic colloid latexes, especially acrylic latexes. Other natural or synthetic binders may be used either alone or in admixture with the gelatin, for example albumin, casein, polyvinyl alcohol and polyvinyl pyrrolidone.

The halide content and ratio of the silver halide present in the silver halide emulsion layer depends on how the material is to be used but all the usual pure bromide, chlorobromide, iodobromide and chlorobromoiodide silver halides are of use in the photographic material in use in the process of the present invention. There may also be present in the silver halide emulsion layer any of the usual addenda present in silver halide emulsion layers such as sulphur and gold sensitisers, emulsion stabilizers, wetting agents and antifoggants.

The support used may be of any of the usual supports used for photographic materials, for example if the support is transparent it may be composed of cellulose triacetate, cellulose acetatebutyrate, oriented and subbed polystyrene, polycarbonate or polyester, such as polyethylene terephthalate. If the support is opaque it may be of any of the above listed film base materials which has been pigmented for example with barium sulphate or titanium dioxide to render its coated surface reflecting, or it may be a paper support having a baryta coating thereon or polyethylene coated paper base. Alternatively it may be voided polyester support.

As hereinbefore stated processing is preferably carried out in an aqueous medium and this is preferably rendered acid with a suitable acid or a buffer mixture, advantageously to a pH value between 0 and 4. The processing and developing speed and the gradation can be varied within wide limits, as a function of the pH value. Preferred suitable acids are: aliphatic, aromatic or heterocyclic mono-, di- and tri-carboxylic acids, which can also contain substituents such as chlorine, bromine and iodine atoms or hydroxyl, nitro, amino or acylamino groups, and also aliphatic or aromatic sulphonic acids or phosphoric acid and mineral acids such as HF, HCl, HBr, $HClO_4$, $HNO_3$, $H_2SO_4$, $H_3PO_4$ and $H_2CO_3$; also $HSO_3^{\ominus}$, $SO_2$ sulphamic acid. Suitable buffers are: $[Al(H_2O)_6]^{3\oplus}$, $HBF_4$, $Na_2S_2O_7$ or $Na_2S_2O_5$.

Preferably an antifoggant is present in the aqueous acid processing medium for example iodide or bromide ions or 1-phenyl-5-mercapto-tetrazole.

The following Examples will serve to illustrate the invention.

EXAMPLE 1

Photographic material as shown in FIG. 4 was prepared by coating sequentially onto 0.1 mm thick white pigmented cellulose triacetate support the following layers.

1. A gelatin layer containing 0.2 g.m.$^{-2}$ of the dyestuff

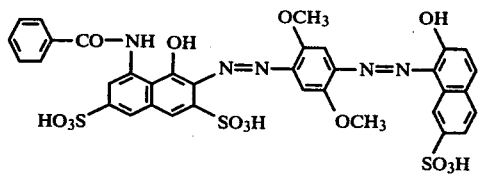

in gelatin 4.0 g.m.$^{-2}$.

2. A stripping layer consisting of phthalated gelatin with a gelatin layer coating weight of 1.0 g.m.$^{-2}$.

3. A photosensitive silver halide gelatin emulsion layer containing 1.2 g.m.$^{-2}$ silver in the form of silver chlorobromide ( 70 mol% of AgCl and 30 mol% of AgBr).

4. A supercoat layer containing gelatin 1.0 g.m.$^{-2}$

After exposure to light behind a grey wedge, the material was processed in the dark by contacting the emulsion side with an aluminiumised support onto which had been applied a processing composition of the following formulation:

| | |
|---|---|
| Pyrazine | 0.2 g |
| Sulphuric acid (5N) | 8.0 ml |
| Calcium fluoride | 0.1 g |
| Hydroxyethyl cellulose (Natrosol type 250 HH) | 1.0 g |

-continued

| | | |
|---|---|---|
| Water | to | 100 ml |

After five minutes the aluminiumised support was removed. During this period the processing solution had softened the phthalated gelatin layer and when the aluminiumised support was removed the silver halide layer and supercoat layer were removed with it to reveal a cyan image of the wedge present on the support. The density of this image was acceptably dark as a final image.

EXAMPLE 2

A material as depicted in FIG. 15 was prepared by coating sequentially onto a 0.1 mm thick uncoloured transparent cellulose triacetate support the following layers:

1. A gelatin layer containing the same dye as use in Example 1.
2. A white reflecting layer.
3. A black opacifying layer.
4. An emulsion layer as used in Example 1.
5. A zinc powder plus carbon black opacifying layer.
6. A supercoat layer containing 1.0 g.m.$^{-2}$.

After exposure to X-rays behind a lead wedge, the material was processed by immersing in a solution of the following composition:

| | | |
|---|---|---|
| 2-acetyl-3-methylquinoxaline | | 0.3 g |
| Sulphuric acid 5N | | 8.0 ml |
| 1-phenyl-5-mercaptotetrazole | | 0.1 g |
| Water | to | 100 ml |

After three minutes a negative cyan image of the wedge was obtained which could be viewed through the support.

The zinc powder/ opacifying layer used in this Example was prepared thus:

A dispersion of zinc powder in gelatin was prepared according to the following formulation:

| | |
|---|---|
| 4% gelatin solution | 100 ml |
| Sodium alkyl naphthalene sulphonate (10% aqueous solution) | 1 ml |
| Zinc powder | 10 g |

20 ml of the above dispersion were added to the carbon black dispersion as hereinbefore described.

EXAMPLE 3

Photographic material as shown in FIG. 4 was prepared by coating sequentially onto a 0.1 mm thick white pigmented cellulose triacetate support the layers 1–4 described in Example 1.

After exposure to light behind a grey wedge, the material was processed in the dark by immersing for 1 minute in a processing solution having the following formulation:

| | |
|---|---|
| Chromic chloride | 50 g |
| Concentrated HCl | 100 ml |
| Water to | 1 liter |

The active metal ion (chromous ions) was produced on shaking this solution with 100 g of amalgamated zinc.

During the processing period the phthalated gelatin layer was softened and on removal of the silver halide layer was removed to reveal a cyan image of the wedge on the support. The density of this image was acceptably dark as a final image.

In a modification to the processing solution used there was included in the processing solution 0.05 g of 1-phenyl-5-mercaptotetrazole: in this case a substantial improvement in the ratio of maximum to minimum density was obtained.

EXAMPLE 4

A material as depicted in FIG. 15 was prepared by coating sequentially onto a 0.1 mm thick uncoloured transparent cellulose triacetate support the following layers.

1. A gelatin layer containing the same dye as Example 3.
2. A white reflecting layer.
3. A black opacifying layer.
4. An emulsion layer as for Example 3 (conventional silver halide).
5. A zinc powder plus carbon black opacifying layer.
6. A supercoat layer containing gelatin 1.0 g.m.$^{-2}$.

After exposure to X-rays behind a lead wedge, the material was processed by immersing in a solution of the following composition:

| | |
|---|---|
| Chromic chloride | 50 g |
| Concentrated hydrochloric acid | 100 ml |
| Water to | 1 liter |

After three minutes a negative cyan image of the wedge was obtained which could be viewed through the support.

The zinc opacifying layer used in the Example was prepared thus:

A dispersion of zinc powder in gelatin was prepared according to the following formulation:

| | |
|---|---|
| 4% gelatin solution | 100 ml |
| Sodium alkyl naphthalene sulphonate (10% aqueous solution) | 1 ml |
| Zinc powder | 10 g |

20 ml of the above dispersion were added to the carbon black dispersion as hereinbefore described.

In this Example the zinc powder present in the photographic material reduces the chromic chloride to chromous chloride.

EXAMPLE 5

A material as depicted in FIG. 14 was prepared by coating sequentially onto a 0.1 mm thick uncoloured transparent cellulose triacetate support the following layers.

1. A gelatin layer containing 0.2 g.m$^{-2}$ of the magenta dyestuff

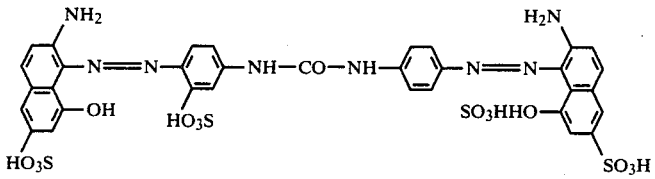

in gelatin 4.0 g.m.$^{-2}$.

2. A white reflecting layer.
3. A black opacifying layer.
4. A silver halide emulsion layer as for Example 4 (conventional silver halide emulsion)
5. A supercoat layer containing gelatin 1.0 g.m.$^{-2}$.

After exposure to light behind a grey wedge, the material was processed in the dark by soaking for one minute in a solution of the following composition:

| | |
|---|---|
| Vanadyl sulphate | 10 g |
| Water to | 1 liter |
| pH | 0.7 |

followed by contacting the emulsion side of the assembly for 2 minutes with a piece of tin foil. After removal of the foil a magenta image of the wedge was obtained which could be viewed through the support.

In this Example the tin foil reduces the vanadyl sulphate to vanadous sulphate.

EXAMPLE 6

A material as depicted in FIG. 14 was prepared by coating sequentially onto 0.1 mm thick uncoloured transparent cellulose triacetate support the following layers:

1. A gelatin layer containing 0.2 g.m.$^{-2}$ of the magenta dyestuff of Example 5 in gelatin 4.0 g.m.$^{-2}$.
2. A white reflecting layer.
3. A black opacifying layer.
4. A direct positive silver halide emulsion containing 1.2 g.m.$^{-2}$ of silver in the form of silver chlorobromide (70 mole % AgCl and 30 mole % AgBr).
5. A supercoat layer containing gelatin 1.0 g.m.$^{-2}$.

After exposure to light behind a grey wedge, the material was processed in the dark by soaking for one minute in a solution of the following composition:

| | |
|---|---|
| Vanadyl sulphate | 10 g |
| Water to | 1 liter |
| pH | 1.2 |

followed by contacting the emulsion side of the assembly for 2 minutes with a piece of bright iron foil. After removal of the foil a positive magenta image of the wedge was obtained which could be viewed through the support.

In this Example the iron foil reduces the vanadyl sulphate to vanadous sulphate.

EXAMPLE 7

The material as depicted in FIG. 23 was prepared by coating sequentially onto 0.1 mm thick uncoloured transparent cellulose triacetate support the following layers:

1. A gelatin layer containing 0.2 g.m.$^{-2}$ of the magenta azo dye of Example 5 in gelatin 4.0 g.m.$^{-2}$.
2. A white reflecting layer.
3. A camera speed direct positive silver halide emulsion containing 1.2 g.m.$^{-2}$ of silver in the form of silver iodobromide (98 mole % bromide, 2 mole % iodide).

The supercoat layer was a thin (0.004 in.) film of cellulose triacetate.

The rupturable pod contained a processing solution having the following formulation:

| | |
|---|---|
| Titanium trichloride (15% solution) | 100 ml |
| Diethylenetetramine pentacetic acid (DTPA) (as 25% solution) | 125 ml |
| Potassium bromide | 8 g |
| Hydroxyethyl cellulose | 10 g |
| Water to | 1 liter |
| pH | 0.75 |

After exposure to light behind a grey wedge the material was processed by passing the assembly (in the dark) through a pair of rollers to rupture the pod and spread the processing solution. After 90 seconds the assembly was examined and a direct positive dye image was visible through the support.

An aqueous solution of titanium ions in the trivalent state complexed with diethylenetetramine penta-acetic acid is stable in the absence of oxygen. Trivalent titanium ions are able to act in aqueous acid solution as a bleach-developer compound.

EXAMPLE 8

In order to produce the photographic assembly shown in FIG. 20 the following layers are applied in the liquid form to a transparent polyester support and then dried.

1. A dispersion of an aluminium powder having an average particle size of 5 μm in gelatin, the amount applied being 300 mg of Al/m$^2$; the thickness of the dry layer is 2.5 μm.
2. A gelatin solution for forming a gelatin interlayer 3 μm thick.
3. A light-sensitive, gelatin-containing silver halide emulsion containing 30 mol % of AgBr and 70 mol % of AgCl, the weight applied being 1.2 g of Ag/m$^2$; the layer thickness is 2.5 μm.

The receiving material consists of a gelatin layer 2 μm thick which contains 300 mg/m$^2$ of the cyan dye of the formula

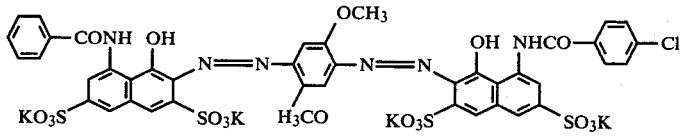

and is likewise coated onto a transparent polyester carrier.

After imagewise exposure of the recording material, the latter and a piece of the receiving material of equal size are treated for 10 seconds at 40° C. in the following bleach-developer solution:

| | |
|---|---|
| $H_2SO_4$ | 20 g (0.2 mol) |
| Ethylene glycol monoethyl ether | 300 ml |
| 2-methyl-3-acetylquinoxaline | 2.5 g (0.01 mol) |
| $NH_4F$ | 0.35 g (0.01 mol) |
| Water to make up to | 1000 ml. |

The recording material and receiving material are then pressed together, the coated sides facing one another, using a pair of rollers. After 60 seconds at 30° C., the two materials are separated. The receiving material displays a dye image which is the negative of the exposure. In order to make the image stable it is then washed with water for one minute.

EXAMPLE 9

After exposure, the material system described in Example 8 is processed in the same way with the bleach-developer solutions 1 to 16 in Table 1 and results similar to those of Example 8 are obtained. The bleach-developer solutions are in each case made up to 1 liter with water.

TABLE 1

| Bleach developer No. | Acid | Solvent | Diazine | Fluoride |
|---|---|---|---|---|
| 1 | $H_2SO_4$ 0.2 M | Ethylene glycol monoethyl ether 300 ml | 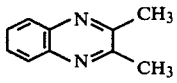 | $NH_4F$ 0.01 M |
| 2 | $H_2SO_4$ 0.2 M | Ethylene glycol monoethyl ether 300 ml | 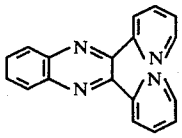 | $NH_4F$ 0.01 M |
| 3 | $H_2SO_4$ 0.2 M | Ethylene glycol monoethyl ether 300 ml | 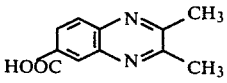 | $NH_4F$ 0.01 M |
| 4 | $H_2SO_4$ 0.2 M | Ethylene glycol monoethyl ether 300 ml | 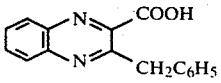 | $NH_4F$ 0.01 M |

TABLE 1-continued

| Bleach developer No. | Acid | Solvent | Diazine | Fluoride |
|---|---|---|---|---|
| 5 | $H_2SO_4$ 0.2 M | Ethylene glycol monoethyl ether 300 ml | 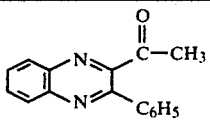 | $NH_4F$ 0.01 M |
| 6 | $H_2SO_4$ 0.2 M | Ethylene glycol monoethyl ether 300 ml | 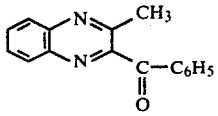 | $NH_4F$ 0.01 M |
| 7 | $H_2SO_4$ 0.2 M | — | 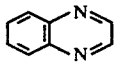 | $NH_4F$ 0.01 M |
| 8 | $H_2SO_4$ 0.2 M | — | 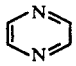 | $NH_4F$ 0.01 M |
| 9 | $H_2SO_4$ 0.2 M | Ethylene glycol monoethyl ether 300 ml | 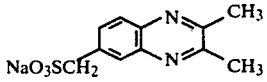 | $NH_4F$ 0.01 M |
| 10 | $H_2SO_4$ 0.2 M | Ethylene glycol monoethyl ether 300 ml | 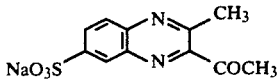 | $NH_4F$ 0.01 M |
| 11 | Sulphamic acid 0.5 M | Ethylene glycol monoethyl ether 300 ml | 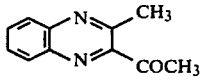 | $NH_4F$ 0.01 M |
| 12 | $H_2SO_4$ 0.5 M | Ethylene glycol monoethyl ether 300 ml | 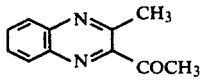 | $NH_4F$ 0.01 M |
| 13 | $H_2SO_4$ 1 M | Ethylene glycol monoethyl ether 300 ml | 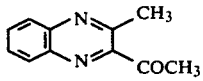 | $NH_4F$ 0.01 M |
| 14 | $HClO_4$ 0.2 M | Ethylene glycol monoethyl ether 300 ml | 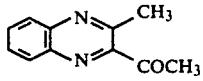 | $NH_4F$ 0.01 M |
| 15 | $H_2SO_4$ 0.2 M | Ethylene glycol monoethyl ether 300 ml | 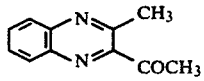 | $CaF_2$ 0.5 g/l dispersed |
| 16 | $H_2SO_4$ 0.2 M | N-Methylpyrrolidone 300 ml | 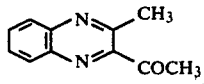 | $NH_4F$ 0.01 M |

EXAMPLE 10

The photosensitive portion of the photographic assembly shown in FIG. 20 is produced by coating the following layers:

1. A dispersion of a copper powder having an average particle size of 15 μm in gelatin, the amount applied being 2 g of $Cu/m^2$; the thickness of the dry layer is 3 μm.

2. A light-sensitive gelatin-containing silver halide emulsion containing 30 mol % of AgBr and 70 mol % of AgCl, the weight applied being 1.2 g of $Ag/M^2$; the layer thickness is 2.5 μm.

The receiving material used is the material described in Example 8.

After imagewise exposure of the photosensitive portion of the assembly the latter and a piece of the receiving material of equal size are treated for 10 seconds at 40° C. in the following activator solution:

| | |
|---|---|
| 70% strength $HClO_4$ | 36 ml |
| 2-Methyl-3-acetylquinoxaline | 3 g |
| Ethylene glycol monoethyl ether | 40 ml |

-continued

| | |
|---|---|
| Allyl alcohol | 150 ml |
| Polyethylene glycol (molecular weight 4,000) | 30 g |
| Water to make up to | 1,000 ml. |

Subsequently, the recording material and the receiving material are squeezed together, the coated sides facing one another, using a pair of rollers. After 60 seconds at 30° C. the two materials are separated. The receiving material displays a dye image which is the negative of the original. In order to make the image stable, it is then washed with water for one minute.

EXAMPLE 11

A photographic material was produced which was similar to Example 10 but which contained, in place of copper, a brass powder having an average particle size of 10 μm and the following elementary composition: copper 85%, zinc 14% and aluminium 1%. Exposure and processing corresponded to Example 10, as did the resulting dye negative.

EXAMPLE 12

A photographic assembly as shown in FIG. 18 is produced by applying the following layers to a transparent polyester support.

1. A gelatin layer which contains 300 mg/m$^2$ of the magenta dye of the formula

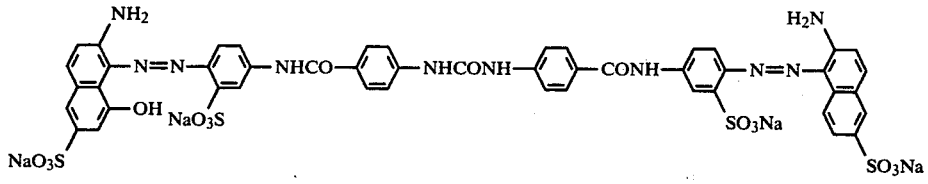

The layer thickness is 3 μm.

2. A gelatin layer which contains 10 mg/m$^2$ of $TiO_2$ in a finely dispersed form. The amount of gelatin applied is 3.5 g/m$^2$.

3. A light-sensitive silver halide emulsion layer of the composition and thickness indicated in Example 8.

4. A gelatin layer containing aluminium powder of the same composition as in Example 8.

The emulsion layer (4) is exposed imagewise through the layer containing the aluminium powder and subsequently is swollen at 40° C. for 10 seconds in the bleach-developer solution according to Example 8, then stripped off and the remainder left to lie for 1 minute at 30° C. After this time, the negative dye image has developed and is visible through the transparent support on the white background of the layer containing titanium dioxide. The image is made stable by washing with water for one minute.

EXAMPLE 13

Photographic material according to FIG. 4 is produced by applying the following layers to a white-pigmented cellulose triacetate support which is 0.1 mm thick.

1. A gelatin layer which contains 200 mg/m$^2$ of the cyan dye used in Example 1 in 4 g of gelatin per m$^2$.

2. A layer of gelatin modified with phthalic anhydride was used as the stripping layer 3. The weight applied is 1 g/m$^2$.

3. A light-sensitive silver halide emulsion layer which contains 1.2 g of silver per m$^2$ in the form of silver chloride/bromide (70 mol percent of silver chloride and 30 mol percent of silver bromide).

4. A supercoat layer which contains 1 g of gelatin per m$^2$.

After imagewise exposure behind a grey wedge the emulsion side of the photographic material is brought into contact with an aluminium carrier to which a bleach-developer solution has been applied which contains the following components:

| | |
|---|---|
| Pyrazine | 0.2 g |
| Sulphuric acid (5 normal) | 8.0 ml |
| Calcium fluoride | 0.1 g |
| Hydroxyethylcellulose (thickener) | 1.0 g |
| Water to make up to | 100 ml |

Contact with the aluminium carrier takes place in the dark and lasts for 5 minutes. During this time the bleach-developer solution has swollen the stripping layer (3). The silver halide emulsion layer and the cover layer together with the aluminium carrier are then separated off. A cyan-coloured negative image of the grey wedge in an adequate colour density is obtained on the cellulose triacetate support.

EXAMPLE 14

A photographic assembly as shown in FIG. 16 was prepared as follows:

A transparent cellulose triacetate support which is 0.1 mm thick is coated as follows:

1. Gelatin dye layer as in Example 13.
2. A white reflecting layer.
3. A black opaque layer.
4. A light-sensitive silver halide emulsion layer as in Example 6.
5. A black opaque layer which contains finely divided zinc powder.
6. A cover layer which contains 1 g of gelatin per m$^2$.

After imagewise exposure of this material to X-rays behind a lead step wedge, the material is developed in a solution which contains the following components:

| | |
|---|---|
| 2-Acetyl-3-methylquinoxaline | 0.3 g |
| Sulphuric acid (5 normal) | 8.0 ml |
| 1-Phenyl-3-mercaptotetrazole | 0.1 g |
| Water to make up to | 100 ml |

After 3 minutes a cyan-coloured negative image of the step wedge becomes visible; the image can be viewed through the transparent support.

The layer (5) is obtained from the following dispersions:

| | | |
|---|---|---|
| (a) | 4% strength aqueous gelatin solution | 100 ml |
| | 10% strength aqueous solution of a sodium alkylnaphthalene sulphonate | 1 ml |
| | zinc powder | 10 g |
| (b) | gelatin | 3 g |
| | water | 40 ml |
| | carbon black dispersion | 5 ml |
| | polyglycidyl condensation product (5% strength, aqueous) | 2.5 ml |

Composition (b) is mixed for 2 minutes and stirred with 20 ml of composition (a) and the resulting mixture is then coated as a layer.

In place of the indicated developer solution, it is also possible to use the following solution:

| | |
|---|---|
| Chromium chloride ($CrCl_3$) | 50 g |
| Hydrochloric acid (37% strength) | 100 ml |
| Water to make up to | 1 liter |

The zinc powder in layer (6) reduces the chromium-III chloride to chromium-II chloride.

EXAMPLE 15

Photographic material as shown in Example 13 (in accordance with FIG. 4) is exposed imagewise behind a grey wedge and then treated for 1 minute in the dark with the following solution, which previously has also been shaken with 100 g of zinc amalgam:

| | |
|---|---|
| Chromium chloride ($CrCl_3$) | 50 g |
| Hydrochloric acid (37% strength) | 100 ml |
| Water to make up to | 1 liter |

During this treatment time the stripping layer becomes swollen. After separating the silver halide emulsion layer from the dye layer, a cyan-coloured negative image of the grey wedge in an adequate colour density is obtained.

If 0.05 g of 1-phenyl-5-mercaptotetrazole is also added to the treatment solution, a distinct improvement in the ratio of the maximum to the minimum colour density is achieved.

EXAMPLE 16

Photographic material as shown in FIG. 14 is produced by applying the following layers to a transparent cellulose triacetate support which is 0.1 mm thick.

1. A gelatin layer which contains 200 mg/m$^2$ of the magenta dye used in Example 5 in 4 g of gelatin per m$^2$.
2. A white reflecting layer (as in Example 10).
3. A black opaque layer (as in Example 14).
4. A light-sensitive silver halide emulsion layer (as in Example 13).
5. A layer which contains 1 g of gelatin per m$^2$.

After imagewise exposure behind a grey wedge the photographic material is treated in the dark for 1 minute with the following solution:

| | |
|---|---|
| Vanadyl sulphate | 10 g |
| Water to make up to | 1 liter |
| (pH value of the solution 0.7) | |

The emulsion side of the material is then brought into contact with a tin foil for 2 minutes. The tin foil reduces the vanadyl-IV sulphate to vanadium-II sulphate. After removing the tin foil, a negative magenta image of the step wedge is obtained and this can be viewed trough the transparent carrier.

EXAMPLE 17

A photographic assembly as shown in FIG. 20 was prepared as described in Example 8 except that the receiving component consisted of a gelatin layer 2 μm thick containing 8 mg/dm$^2$ in gelatin 80 mg/dm$^2$ of the anthraquinone dyestuff of the formula:

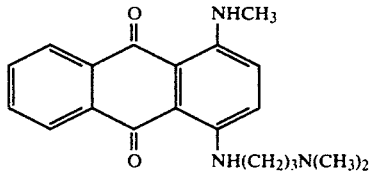

(as prepared in Swiss Pat. No. 594023) which was coated on a transparent polyester support base.

After imagewise exposure of the photosensitive component of the photographic assembly a piece of this component and a piece of the receiving component of equal size were treated for 10 minutes at 40° C. in the bleach-developer solution set forth in Example 8. A blue negative dye image was obtained.

EXAMPLE 18

A photographic assembly as shown in FIG. 20 was prepared as described in Example 8 except that the receiving component consisted of a gelatin layer 2 μm thick containing 8 mg/dm$^2$ in gelatin 80 mg/dm$^2$ of the triphenylmethane dyestuff of the formula:

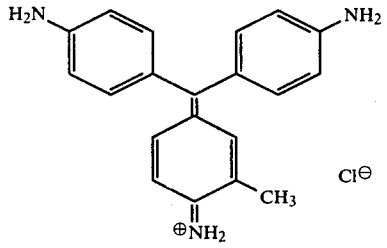

(which is the well known dyestuff rosaniline) which was coated on a transparent polyester base.

After imagewise exposure of the photosensitive component of the photographic assembly, a piece of this component and a piece of equal size of the receiving component were treated for 10 minutes at 40° C. in the bleach developer solution set forth in Example 8. A magenta negative dye image was obtained.

EXAMPLE 19

A photographic assembly according to Example 5 was prepared by using in layer (1) 0.7 gm$^{-2}$ manganese dioxide ($MnO_2$) instead of the magenta dyestuff.

Exposure and processing of this material is carried out as described in Example 5. A brown negative image of the wedge is obtained.

Manganese dioxide is prepared by reduction of potassium permanganate ($KMnO_4$) (0.5 molar aqueous solution) with methylalcohol. The solution is stirred at room temperature for two hours, then the dioxide is filtered off, washed with water and dispersed in an aqueous gelatin solution which is then used to coat layer (1) on the cellulose triacetate support.

We claim:

1. Process for the production of photographic images which comprises the steps of:

(a) imagewise exposing a photographic assembly which contains at least during the silver halide developing step, in order optionally a supercoat layer, at least one silver halide emulsion layer, a layer containing a preformed substantive bleachable dye or pigment and a support, there being optionally one or more interlayers between each of said components, (b) treating the exposed photographic assembly with an aqueous acid processing bath so as to provide in the silver halide emulsion layer or layers a solution or dispersion of a bleach developer compound which is either a reduced silver dye bleach catalyst which is an azine compound or is a salt of a metallic ion or a complex of a metallic ion with a suitable ligand which is capable of acting as a silver halide developing agent, thereby to develop the latent silver image in the silver halide emulsion(s), and (c) in the non-latent image areas allowing the bleach developer compound to diffuse in a counter-imagewise manner from the silver halide emulsion layer(s) to the layer containing the bleachable dye and there to bleach the bleachable dye or pigment to form a photographic image.

2. A process according to claim 1 wherein the bleach developer compound is in the form of a preformed solution or dispersion which is applied to the exposed photographic assembly in step (b).

3. A process according to claim 1 wherein the bleach developer compound is in an oxidised form and a solution or dispersion of this compound is contacted with a reducing agent which reduces the compound just before or whilst the solution or dispersion is applied to the exposed photographic assembly in step (b).

4. A process according to claim 1 wherein a solution or dispersion of an oxidised form of the image bleach developer compound is applied to the photographic assembly in step (b), the photographic assembly comprising either in the supercoat layer or below the supercoat layer and above the bottom-most silver halide emulsion layer a compound in layer form which reduces the oxidised bleach developer compound.

5. A process according to claim 1 wherein the bleach developer compound is present initially in a layer in the photographic assembly in an oxidised form and in step (b) a solvent for the compound is applied to the exposed photographic assembly and the thus formed solution of the oxidised compound is treated in the assembly to convert the compound to the reduced form.

6. A process according to claim 5 wherein the solution of the oxidised form of the bleach developer compound is reduced by bringing it into contact with a reducing agent which reduces the compound and which is also present in layer form in the photographic assembly.

7. A process according to claim 1 wherein the bleach developer compound is in an oxidised form and a solution or dispersion of this compound is subjected to electrolysis to convert the oxidised compound to the reduced form just before or whilst the solution or dispersion is applied to the photographic assembly.

8. A process according to claim 7 wherein the photographic assembly is subjected to electrolysis at the same time or just after the solvent is applied to the assembly thereby converting the oxidised form of the compound to the reduced form in the assembly.

9. A process according to claim 1 wherein the photographic assembly is prepared as two sections, one section comprising the supercoat and the silver halide emulsion layer(s) and the other section comprising the layer which contains the bleachable dye or pigment.

10. A process according to claim 1 wherein the photographic assembly is prepared as a single assembly which contains the supercoat, the silver halide emulsion layer(s) and the layer which contains the bleachable dye or pigment coated on the support.

11. A process according to claim 10 wherein in the photographic assembly used there is either a stripping layer or a stripping position between the silver halide emulsion layer(s) and the layer which contains the bleachable dye or pigment.

12. A process according to claim 11 wherein the stripping layer contains phthalated gelatin.

13. A process according to claim 1 wherein the silver halide emulsion is a negative working silver halide emulsion.

14. A process according to claim 1 wherein in the silver halide emulsion is a direct positive silver halide emulsion.

15. A process according to claim 1 wherein the bleachable image dye is an azo dye or a bleachable pigment.

16. A process according to claim 15 wherein the bleachable dye is an anthraquinone dye or a triphenylmethane dye.

17. A process according to claim 15 wherein the bleachable pigment is a metallic oxide.

18. A process according to claim 17 wherein the metallic oxide is manganese dioxide.

19. A process according to claim 1 wherein the bleach-developer compound is an azine compound in its reduced form and the aqueous processing bath is an aqueous acid bath.

20. A process according to claim 19 wherein the azine is pyrazine.

21. A process according to claim 19 wherein the azine is a quinoxaline compound which is optionally substituted in the 2-, 3-, 5-, 6- and/or 7-position by lower alkyl, hydroxyalkyl or alkoxy, each of 1 to 4 carbon atoms, acylated hydroxymethyl, amino or acylated amino, carboxyl, sulfonic acid, benzoyl, acetyl, phenyl, benzyl or pyridyl.

22. A process according to claim 19 wherein a non-reduced azine in a higher valency state than the active form in an acid solution or dispersion is contacted with a reducing agent just before or as it is applied to the photographic assembly.

23. A process according to claim 1 wherein the bleach-developer compound is a metallic ion which is able to act as a silver halide developer in an acid solution.

24. A process according to claim 23 wherein the metallic ion is a chromous, vanadous or titanous ion.

25. A process according to claim 23 wherein a metallic ion in a higher valency state than the active form in an acid solution or dispersion is contacted with a reducing agent just before or as it is applied to the photographic assembly.

26. A process according to claim 22 or 25 wherein the reducing agent is a metal which in the electrochemical series is above silver and up to and including lanthanum.

27. A process according to claim 26 wherein the reducing agent is a metal which in the electrochemical series is above silver and up to and including aluminium.

28. A process according to claim 26 wherein the metal is in the form of a metal strip.

29. A process according to claim 28 wherein the metal strip is composed of aluminium, iron, zinc, tin or alloys which include such metals.

30. A process according to claim 29 wherein the metal is in the form of a paste coated on a base.

31. A process according to claim 30 wherein the paste contains aluminium, iron, zinc, tin, indium, gallium or alloys which include such metals.

32. A process according to claim 19 or 23 wherein a non-reduced azine or metallic ion in a higher valency state than the active form is applied as an acid solution or dispersion to the photographic assembly which contains in a layer thereof a dispersion of a metal which in the electrochemical series is above silver and up to and including lanthanum.

33. A process according to claim 32 wherein the metal used is aluminium, copper, iron, nickel, zinc, tin, indium, gallium, lanthanum or alloys which include such metals.

34. A process according to claim 32, wherein the reducing agent is a metal which in the electrochemical series is above silver and up to and including aluminium.

35. A process according to claim 1 wherein in the photographic assembly there is at least one light opaque layer adjacent to a silver halide emulsion layer.

36. A process according to claim 35 wherein there is one silver halide emulsion layer and there is a light-opaque layer on each side thereof.

37. A process according to claim 1 wherein in the photographic assembly there is a white reflecting layer adjacent to the layer containing the bleachable dye or pigment on the side remote from the support.

38. A process according to claim 1 wherein the photographic assembly contains in order a supercoat layer, a light opaque layer, a silver halide emulsion layer, a light opaque layer, a layer containing a bleachable dye or pigment and a support.

39. A process according to claim 38 wherein there is present between the second mentioned light opaque layer and the layer containing the bleachable dye or pigment a stripping position or stripping layer.

40. A process according to claim 38 wherein there is present between the second mentioned light opaque layer and the layer containing the bleachable dye or pigment a white reflecting layer.

41. A process according to claim 40 wherein there is present between the second mentioned light opaque layer and the white reflecting layer a stripping position.

42. Process according to claim 1 which comprises the steps of:

(a) imagewise exposing a photographic assembly which contains at least during the silver halide developing step, in order, at least one silver halide emulsion layer, a layer containing a preformed substantive bleachable dye or pigment and a support, (b) treating the exposed photographic assembly with an aqueous acid processing bath so as to provide in the silver halide emulsion layer or layers a solution or dispersion of a bleach developer compound which is either a reduced silver dye bleach catalyst which is an azine compound or is a salt of a metallic ion or a complex of a metallic ion with a suitable ligand which is capable of acting as a silver halide developing agent, thereby to develop the latent silver image in the silver halide emulsion(s), and (c) in the non-latent image areas allowing the bleach developer compound to diffuse in a counter-imagewise manner from the silver halide emulsion layer(s) to the layer containing the bleachable dye and there to bleach the bleachable dye or pigment to form a photographic image.

* * * * *

UNITED STATES PATENT AND TRADEMARK OFFICE

CERTIFICATE OF CORRECTION

PATENT NO. : 4,271,254

DATED : Jun. 2, 1981

INVENTOR(S) : Leslie F.A. Mason et al

It is certified that error appears in the above-identified patent and that said Letters Patent are hereby corrected as shown below:

Title Page Delete "40811" and insert --48011--.
Priority

Signed and Sealed this

*Twenty-seventh* Day of *July 1982*

[SEAL]

*Attest:*

GERALD J. MOSSINGHOFF

*Attesting Officer*

*Commissioner of Patents and Trademarks*